US007287567B2

(12) United States Patent
Fujiwara

(10) Patent No.: US 7,287,567 B2
(45) Date of Patent: Oct. 30, 2007

(54) TAPE APPLICATION JIG FOR PRESSURE SENSITIVE ADHESIVE TAPE

(75) Inventor: Daisuke Fujiwara, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 11 days.

(21) Appl. No.: 10/530,468

(22) PCT Filed: Oct. 1, 2003

(86) PCT No.: PCT/US03/30951

§ 371 (c)(1),
(2), (4) Date: Apr. 6, 2005

(87) PCT Pub. No.: WO2004/039712

PCT Pub. Date: May 13, 2004

(65) Prior Publication Data

US 2005/0257892 A1 Nov. 24, 2005

(30) Foreign Application Priority Data

Oct. 28, 2002 (JP) ..... 2002-312741

(51) Int. Cl.
*B32B 37/00* (2006.01)
*B32B 43/00* (2006.01)
*B65H 29/52* (2006.01)

(52) U.S. Cl. ..... 156/391; 156/538; 156/556; 156/574; 156/71; 156/166; 156/247

(58) Field of Classification Search ..... 156/391, 156/538, 556, 574, 71, 166, 247
See application file for complete search history.

(56) References Cited

U.S. PATENT DOCUMENTS

| | | | | |
|---|---|---|---|---|
| 6,585,023 | B2 | 7/2003 | Azuhata | |
| 6,698,489 | B1 | 3/2004 | Shinozaki et al. | |
| 6,748,993 | B1 * | 6/2004 | Shinozaki et al. | 156/391 |

FOREIGN PATENT DOCUMENTS

| | | | |
|---|---|---|---|
| JP | 2000159426 | A * | 6/2000 |
| JP | 2001-97636 | | 4/2001 |
| JP | 2001171570 | A * | 6/2001 |
| JP | 2001-328573 | | 11/2001 |
| JP | 2002-167110 | | 6/2002 |
| WO | WO 01/10703 | A1 | 2/2001 |

OTHER PUBLICATIONS

English Machine Translation of JP 2001-97636.*
English Machine Translation of JP 2000-159426.*
English Abstract of JP 2000-159426.*

* cited by examiner

*Primary Examiner*—Chris Fiorilla
*Assistant Examiner*—Sing P. Chan
(74) *Attorney, Agent, or Firm*—Harold C. Knecht, III

(57) ABSTRACT

A tape application jig (10) comprising a tape application head (2), a jig guide (3) and a tape holding member consisting of a pair of members (6, 16) combined so as to face each other in vertical direction. The jig guide (3) comprises a guide pin (13) capable of abutting during the movement of the jig guide against the surface of the adherent opposite to the tape applying surface portion.

29 Claims, 5 Drawing Sheets

TAPE APPLICATION JIG FOR PRESSURE SENSITIVE ADHESIVE TAPE

CROSS REFERENCE TO RELATED APPLICATIONS

This application claims priority from International Application No. PCT/US2003/030951, filed Oct. 1, 2003, which claims priority from Japanese Patent Application No. JP2002-312741, filed Oct. 28, 2002.

FIELD OF THE INVENTION

The present invention relates to a jig for applying a tape, in particular, to a tape application jig for applying an adhesive-backed tape and, more particularly, to such a jig that is capable of applying a pressure sensitive adhesive-backed tape continuously to an adherend that has bent portions and/or curved portions.

BACKGROUND OF THE INVENTION

Conventionally, when a pressure sensitive adhesive-backed tape is to be applied to an adherend such as, for example, a pressure sensitive adhesive-backed paint replacement film in tape form to a window sash frame of an automobile, generally, it is usual practice to utilize a tape application jig. This is because when a pressure sensitive adhesive tape is to be applied and adhered under pressure manually and carefully to a predetermined surface portion of the adherend so as not to give rise to puckering or inclusion of air bubbles, an excessive labor and time, in addition to the required skill, is needed for the tape application operation.

A tape application jig that is currently used in general is composed typically of an tape application unit for pressing and adhering the pressure sensitive adhesive tape to an adherend, a guide unit for maintaining the position and distance of the tape application jig relative to the adherend, and a tape holding unit for holding the pressure sensitive adhesive tape and feeding the adhesive tape to the tape application unit. In such a tape application jig, the position of the tape application jig relative to the adherend is generally maintained by holding the guide unit of the tape application jig in abutment against a predetermined surface portion of the adherend (for example, a sash frame). It is desirable that the guide unit and the tape application unit composing the tape application jig are disposed in axial alignment with each other or positioned in close proximity with each other.

Shape of an adherend, for example a sash frame of an automobile, has become increasingly diversified with recent diversification of vehicle type. A sash frame may be bent in its way or may be curved. Bent portion of a frame may be bent at a right angle or at an acute angle.

FIG. 1 is a view illustrating an example of usage of a typical prior art tape application jig 100 for applying a pressure sensitive adhesive tape 11 to a tape applying surface 20*a* of a sash frame 20 of an automobile having a bent portion 21. The sash frame 20 used in this example has a bent portion 21 with the angle θ which is substantially equal to 120 degrees. The tape application jig 100 is comprised of a tape application head 102, a tape holding member 106, and a jig guide 103 in the shape of a roller. The pressure sensitive tape 11 further comprises release paper 12 that protects the adhesive surface thereof prior to application.

The tape application jig 100 is first mounted to the end portion of the adherend 20, and application of the pressure sensitive tape is started from the straight portion. Then, the application jig 100 is moved in the direction of the arrow F and the tape application operation is continued. At the bent portion 21 of the adherend 20, the tape application operation cannot be continued as it is. Thus, typically, the application jig 100 is removed so that the orientation of the jig may be changed or a special jig guide for bent portion may be attached to the adherend. However, these works are complicated and not only increase the number of processing steps, but also may give rise to damages in the pressure sensitive adhesive tape. In the illustrated example, an advancing guide 109 is provided at the front end of the application jig 100 as shown in FIGS. 2A-2C. The advancing guide 109 is intended to facilitate smoother movement of the application jig 100.

More specifically, as shown in FIG. 2A, when the tape application jig 100 reaches the bent portion 21 of the adherend 20, the jig 100 is released from the tape application position, and the advancing guide 109 abuts against the adherend 20. Then, as shown in FIGS. 2B and 2C, the tape application jig 100 is moved along the bent portion 109 while maintaining the advancing guide 109 in abutment against the adherend 20. Although the pressure sensitive adhesive tape is not shown in FIGS. 2A-2C for the sake of simplicity of explanation, continuous application of the pressure sensitive tape is thus possible.

However, there is still room for improvement for the tape application jig described above with reference to FIGS. 1 and 2. For example, although the advancing guide is provided at the front end of the application jig, change of advancing direction is not easily performed, and great care needs to be given to the movement of the jig, leading to excessive labor and time required for the tape application operation. In addition, the jig needs to be released in the process of tape application, so that interruption of the tape application operation tends to give rise to a line of application mark on the surface of the tape or an inclusion of air bubble. In addition, conventional application jig has a drawback that the adhesive tape cannot be held reliably at the bent portion or curved portion of the adherend. Moreover, conventional tape application jig has a limit in the angle of the bent portion of adherend which permits the jig to be utilized, and the jig can be used only to such an adherend that has a bent portion 21 in FIG. 1 with the angle θ not less than 110 degrees.

SUMMARY OF THE INVENTION

An advantage of at least one embodiment of a tape application jig according to the present invention is that a pressure sensitive adhesive-backed tape can be held reliably and applied to the adherend quickly and smoothly by moving the tape application jig continuously along the tape applying surface portion of the adherend, that is, without removing and re-attaching the jig during the tape application operation, even when the adherend is of a complex shape. Another advantage of at least one embodiment of the jig of the invention is that the pressure sensitive adhesive tape can be applied to the adherend continuously even when the adherend has a bent portion at an acute angle. An additional advantage of at least one embodiment of the jig of the invention is that the pressure sensitive adhesive tape can be applied to the adherend continuously even when the adherend has a bent portion at a right angle.

In at least one embodiment of the present invention, a tape application jig for a pressure sensitive adhesive tape is provided that permits tape application operation to be carried out quickly and reliably without requiring higher skill of a worker, especially when the pressure sensitive adhesive tape is to be applied to an elongated adherend having bent portions or curved portions on its way such as, for example, a sash frame of an automobile.

In at least one embodiment of the present invention, a tape application jig can be provided that eliminates, or at least substantially reduces, the need to remove the application jig from the adherend and to perform tape application work manually, even when a bent portion, for example, appears in the way of tape application operation.

In at least one embodiment of the present invention, a tape application jig for a pressure sensitive adhesive tape can be provided that permits the advancing direction of the tape application jig to be changed easily even at the bent portion of the adherend with the angle of 90 degrees or less, while allowing the adhesive tape to be held reliably.

The inventor of the present invention has found unexpectedly that one or more of the problems found in the prior art can be overcome by adding a guide pin to the jig guide composing the tape application jig for pressure sensitive adhesive tape, and/or by composing the tape holding member from two members, upper and lower members, that are combined in vertical direction.

In one aspect, the present invention provides a tape application jig for applying a pressure sensitive adhesive tape to an adherend having bent portions, curved portions, corner portions and/or the like, comprising:

a tape application head for applying under pressure said pressure sensitive adhesive tape to a tape-applying surface of said adherend;

a jig guide disposed on the opposite side of said adherend to said tape application head for guiding said application jig along the surface of said adherend; and a tape holding member composed of a pair of members facing each other in vertical direction, thereby forming a tape-guiding space;

wherein said jig guide further comprises a guide pin capable of abutting against the surface of the adherend on opposite side to the tape applying surface of said adherend during movement thereof.

DETAILED DESCRIPTION OF THE INVENTION

Figure 1:
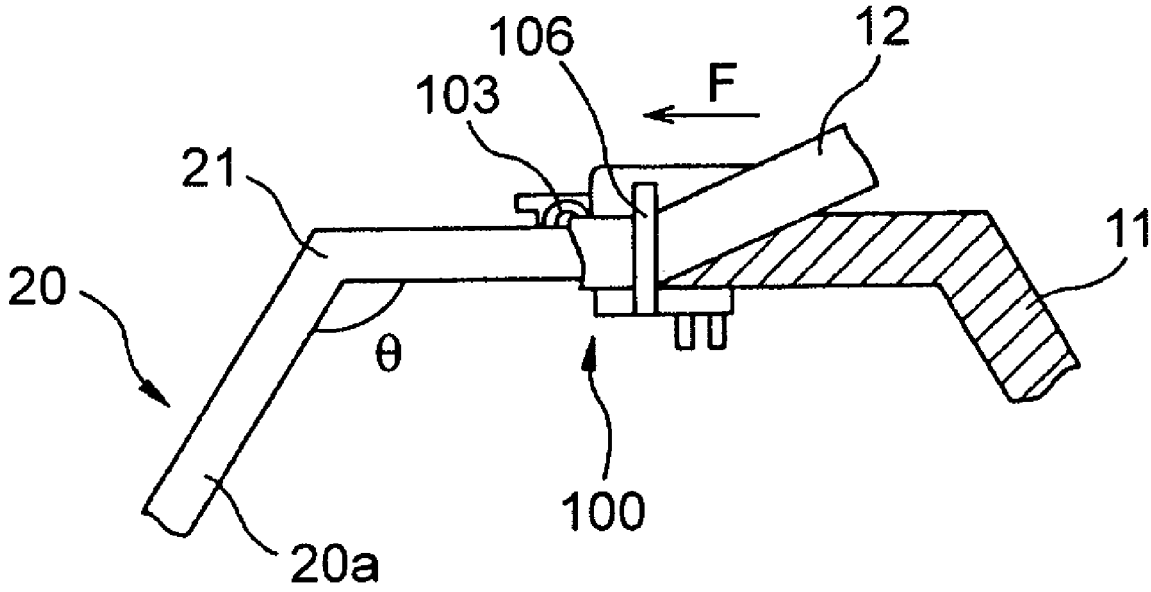
FIG. 1 Prior Art
FIG. 1 is a view illustrating an example of the usage of conventional tape application jig for a pressure sensitive adhesive tape.
Figure 2A:
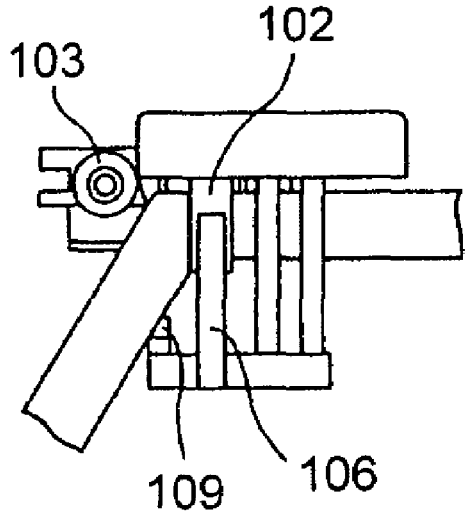
FIG. 2A Prior Art
FIGS. 2A, 2B and 2C are views illustrating sequentially the steps of the movement of the tape application jig of FIG. 1 at a bent portion of the adherend.
Figure 2B:
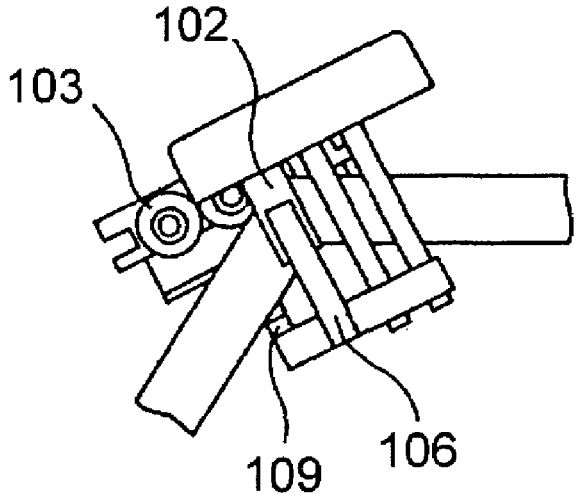
FIG. 2B Prior Art
Figure 2C:
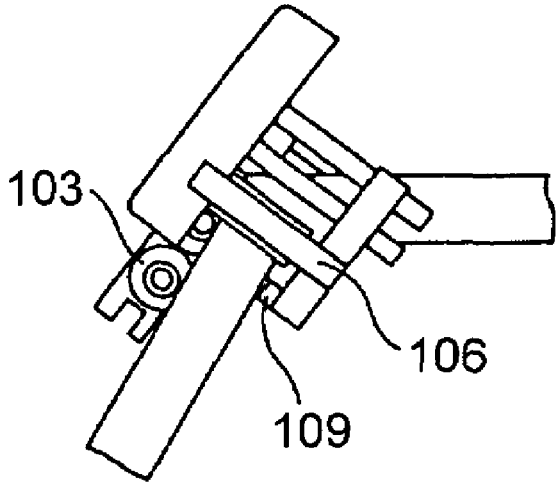
FIG. 2C Prior Art

A tape application jig according to the present invention comprises at least a tape application head, a jig guide and a tape holding member as its components. Any one of these components may have the function of a jig main body, but typically these components are mounted on, or supported by, a separate jig main body.

The tape application head is intended to apply and adhere the pressure sensitive adhesive tape under pressure to a tape applying surface portion of the adherend, and is preferably disposed in the vicinity of the side of the jig main body. The jig guide is intended to guide the tape application jig of the invention continuously along the adherend, and is typically disposed beneath the jig main body in a position opposing to the tape application head with the adherend sandwiched therebetween, that is, on the side of the adherend opposite to the tape application head. The jig guide may be disposed on the side of the jig main body. The tape holding member is intended to hold the tape application head reliably and to feed the pressure sensitive adhesive tape successively to the tape application head in accordance with the progress of tape application operation, and is disposed typically above the tape application head. In the tape application jig of the invention, the above components and other components used as required are preferably arranged in association with each other so as to form the tape application jig of the invention in a compact and light-weight fashion and to improve the handling performance and the like of the jig.

In the tape application jig of the present invention, the tape application head is used to apply and adhere the pressure sensitive adhesive tape under pressure to the tape applying surface of the adherend. The tape application head is capable of positioning the pressure sensitive adhesive tape to the tape applying surface portion of the adherend, pressing and reliably adhering the tape under pressure to the desired surface portion of the adherend. Typically, the tape application head is used as mounted to an appropriate supporting frame, and the supporting frame having the tape application head mounted to it is, in turn, mounted on the jig main body. The supporting frame and the jig main body may be formed as a common integrated member.

The tape application head may be of various shapes and sizes, and may be formed of various suitable materials. For example, the tape application head may be formed from a cylindrical member or a plate member. A cylindrical member, in particular, may be composed rotatably on the adherend, and may be thus used advantageously to obtain an improved pressure-bonding effect. As a variant of cylindrical members, a cylindrical member having flat upper and lower surfaces may be used. Size of the tape application head may be varied arbitrarily taking into account the overall size of the tape application jig or the size of the jig guide used in combination with it.

In order to be able to press the pressure sensitive adhesive tape successively, preferably with gradually increasing pressure applied to it, onto the tape applying surface portion of the adherend while sliding the tape application head smoothly on the tape applying surface portion of the adherend, and to adhere finally the pressure sensitive adhesive tape in close contact to the tape applying surface portion of the adherend, the tape application head, or at least a surface portion thereof, is preferably constructed with a surface layer having the function of a slide promoting layer or a buffer layer for the pressure sensitive adhesive tape. Examples of suitable materials for the surface layer includes, for example, elastic materials such as natural and synthetic rubber, foam plastic materials such as foam polyurethane, and various felt materials and the like. Surface of elastic materials may be coated with a thin skin layer to increase mechanical strength. Core material for such a tape application head may be, for example, a metal, plastic, etc. Plastic materials can be used advantageously in view of its light weight and good workability.

The number of tape application heads used may be only one, or may be two or more as required. When a plate member, for example, is used, a single head is preferred. When cylindrical member is used, two or more heads are preferred. When a plurality of tape application heads are used, these heads may or may not be identical. By using different type of application heads in combination, a greater effect would be obtained for pressing the tape to the adherend.

With the tape application head of the present invention, a tape holding member is further utilized so as to form a tape-guiding space for facilitating the process of feeding the pressure sensitive adhesive tape successively to the tape application head, and for holding the adhesive tape stably and securely. Thus, when a typically slit-shaped tape guiding space is formed so as to provide a constant distance between the tape holding member and the tape application head, the pressure sensitive adhesive tape can be advanced reliably to the tape application head under a predetermined tension without giving rise to fluctuations or deviations from the intended path. The tape holding member used in the present invention is composed of a pair of members combined so as to face each other in vertical direction to obtain improved tape holding effect. Here, although the combination of the two members may be arbitrarily changed as long as the operative effect of the invention can be obtained, it is usually desirable to combine an upper plate member or rod-like member having rectangular cross section with a lower plate member opposing thereto and having angle cross section. In addition, in order to obtain an improved holding effect for the pressure sensitive adhesive tape, the member with angle cross section has preferably a height that increases in a step-wise fashion as will be described more specifically below. The upper tape holding member is mounted to the supporting frame or to the jig main body fixedly or rotatably or so as to permit open/close operation, with the main surface thereof extending generally in parallel to the advancing plane of the pressure sensitive adhesive tape. On the other hand, the lower tape holding member is usually mounted in a position such that the bulging-out of the tape to the side of the tape application head can be prevented, so as to fulfill the tape holding function.

The tape holding member may be formed in any shape and size and from any material as long as the advance of the pressure sensitive tape is not adversely affected. For example, as can be seen from the foregoing discussion, shape of the tape holding member may be thin rod of circular or square cross section or may be elongated plate or wide plate. Size of these tape holding members may be changed arbitrarily in accordance with the size of the pressure sensitive adhesive tape. The tape holding member may be formed of metal, plastic or any other materials. Plastic moldings, however, can be used advantageously when workability, weight, and the like are taken into account.

The tape holding member is preferably modified to an improved construction such that the pressure sensitive adhesive tape can be easily and stably mounted to the jig and falling-off of the adhesive tape from the jig can be prevented so as to ensure stable feed of the tape. For example, end portion (free end) of the upper tape holding member, as well as corresponding portion of the tape application head located underneath, has a slit-like opening, that is, an open port for mounting the pressure sensitive adhesive tape. In particular, the free end portion of the tape holding member is preferably inclined from the front end inwardly toward the tape guiding space so as to form a notched portion in order to prevent the mounted adhesive tape from deviating out of the advancing path during the tape application operation and to facilitate the removal of the pressure sensitive adhesive tape from the jig as required. More preferably, the notched portion is provided with a return portion so as to form a notched portion with a tape-stopper.

In addition, although the upper tape holding member may be mounted fixedly to the supporting frame or the like of the tape application head, it is more preferable to mount the upper tape holding member rotatably or openably, that is, so as to be able to open the formed tape guiding space. If the tape guiding space is capable of being opened, it can be opened at the time of mounting or removing the pressure sensitive adhesive tape so as to be able to provide a large opening and prevent occurrence of damages or puckerings to the pressure sensitive adhesive tape. When the pressure sensitive adhesive tape is to be mounted to the tape application jig, if the mounting port for the tape is thus made wide, workability can be improved significantly. The rotation mechanism of the tape holding member may be constructed, for example, by securing the tape holding member to the supporting frame with a screw and by mounting the tape holding member rotatably around the screw. The open/close mechanism of the tape holding member may be constructed, for example, by providing the supporting frame with a hinge or similar means and mounting the tape holding member foldably on the supporting frame. In addition, a knob or a handle may be attached to appropriate position on the tape holding member in order to facilitate rotation or open/close operation of the tape holding member.

In the tape application jig of the present invention, a jig guide is used for moving the jig along the adherend. The jig guide is intended to maintain the distance and position of the tape application jig relative to the adherend, and to keep the movement of the entire jig in a constant direction along the shape of the adherend when applying the pressure sensitive tape, and to move the jig smoothly and to achieve thereby proper movement of the tape application head. Thus, it abuts against a predetermined position of the adherend so as to be able to sandwich the adherend in combination with the tape application head. The jig guide used in the tape application jig of the present invention differs from the conventional jig, as will be described in detail below, in that a guide pin is further provided which is capable of abutting against the surface of the adherend opposite to the tape applying surface during the movement of the jig guide. Typically, a single guide pin is sufficient for this purpose, although two or more pins may be provided. The guide pin may be attached to different position depending on the shape of the jig guide. If the jig guide is composed of a plate member or a member of similar shape, the guide pin may be attached directly to the member. If the jig guide is composed of rotatable roller(s), the guide pin may be attached to the member supporting the roller(s).

The guide pin is typically used in the form of a small cylinder. Size of the guide pin may be varied depending upon the size of the tape application jig, and is typically about 1 to 5 mm in diameter and about 1 to 10 mm in height. There is no special limitation to the material of the guide pin, and iron and stainless steel may be advantageously used in view of strength and ease of attachment.

Usually, the jig guide may be constructed by mounting it fixedly or movably to the jig main body or to the supporting frame. There is no special limitation to the shape, size and material of the jig guide as long as it is capable of accomplishing the intended function of smooth movement of the jig and proper movement of the tape application head. For example, the jig guide may be formed of any guide member such as a roller, plate or the like. When a jig guide in the shape of roller is used, a single roller or two or more rollers may be used, and the roller may be rotatable or may be fixed. For example, a jig guide may be composed of at least two rotary rollers arranged side by side in parallel. Size of such a jig guide may be varied arbitrarily taking into account the overall balance of the jig as a whole. If the jig guide is too small, it may not be able to support the adherend stably.

The jig guide may be formed of metal, plastic or other materials having different slidabilities, by methods such as molding into a rotary roller or any other suitable form. As an example, plastic material having hard or soft slidability may be formed into the shape of a rotary roller. Rotary rollers may take various forms within the scope of the present invention. For example, it may be formed solely of hard or soft plastic material, or it may be a rotary roller having at least surface portion thereof formed of an elastic material. Examples of suitable elastic materials include natural and synthetic rubber, foam plastic materials such as foam polyurethane, various felt materials, and the like. A plate-shaped jig guide is preferably formed of plastic materials having hard or soft slidability in view of durability.

In the tape application jig of the present invention, the jig guide may consist solely of above-described jig guide, or may be a combination of above-described jig guide (hereinafter referred to as "a first jig guide") and an additional jig guide (a second jig guide). The second jig guide has the function of supporting and enhancing the effect of the first jig guide. Thus, by using the second jig guide, the position of the tape application jig relative to the adherend can be kept constant, and the adherend can be sandwiched between the first and second jig guides, and the posture of the tape application jig can be controlled efficiently. The second jig guide may be of any shape and size as long as it can sandwich the adherend in cooperation with the first jig guide. It is desirable, however, to form it as compact as possible in view of realizing smaller jig as a whole. Basically, the second jig guide may have same shape and size as the first jig guide. The second jig guide consists preferably of plastic rotary rollers. A single rotary roller may be used, or two or more rotary rollers of identical or different shape and size may be used in combination. When plural rotary rollers are used, they are preferably used side by side in parallel arrangement.

Similarly as the first jig guide, the second jig guide is preferably disposed on the side opposite to the tape application head with the adherend sandwiched therebetween. The arrangement of the second jig guide may be varied arbitrarily, and it is desirable to select an optimum pattern of the arrangement of the second jig guide in association with the arrangement of the first jig guide.

In the tape application jig of the present invention, it is advantageous as mentioned above to support each of the components of the jig by a supporting member, preferably a supporting frame, or by the jig main body as a substitute for the supporting member. Each of the components is usually supported by its own special supporting frame, but may be supported by a common supporting frame as required. Two or more supporting frames may be united integrally into one unit using joining means such as bolts and nuts, adhesives, etc. These supporting frames are usually attached to the jig main body, but one supporting frame may be attached via another supporting frame to the jig main body as appropriate. It is desirable to select suitable size and shape of the supporting frame taking into account the workability and handling characteristics of the jig. Suitable materials for the supporting frame include metals such as iron, aluminum, and other alloys, plastic materials such as polypropylene resins, polyethylene resins, polyacetal resins, ABS resins, nylon resins, fluororesins, acryl resins, and the like. Among these materials, especially suitable material is a light-weight plastic material with which the weight does not become a burden upon lengthy work. As will be described below, in order to improve handling characteristics, it is desirable in the tape application jig of the present invention to use a grasping tool. The supporting frame itself may be provided with the function of a grasping tool.

In the tape application jig of the present invention, a biasing member is preferably mounted to the jig main body, or to other component as required, in order to improve the process of setting the pressure sensitive adhesive tape to the tape application jig, and to control tape application and pressing force exerted on the pressure sensitive adhesive tape. For example, a biasing member may be mounted to the tape application head, the jig guide, the tape holding member, or the supporting frame for these components. When a biasing member is mounted to at least one of the tape application head and the jig guide, vertical separation between the tape application head and the jig guide can be adjusted by the extension and contraction of the biasing member.

Although there is no special limitation to the biasing member as long as the member fulfills the expected function, the biasing member is preferably an extensible/contractible member such as a spring. In order to construct the jig as compact as possible, main portion of such a biasing member is preferably mounted, for example, internally to the jig main body or the component itself or to an opening provided on the supporting frame of these components. When, for example, the biasing member is provided in the jig main body, separation between the tape application head and the jig guide may be increased by contraction of the biasing member so that the process of attaching the tape application jig to a predetermined surface portion of the adherend can be carried out easily and accurately. When the biasing member is returned to the initial open state, the tape application head and the jig guide can abut against the adherend under proper pressing force so that the pressure sensitive adhesive tape may be applied to the adherend under an increased pressure.

The tape application jig of the present invention preferably comprises a grasping tool in addition to the biasing member, preferably in combination with the biasing member, since tape application operation for the pressure sensitive adhesive tape and extension and contraction of the biasing member can be carried out easily with the aid of the grasping tool. Typically, the grasping tool is preferably used as a pair of plate-shaped plastic members attached to the jig main body or to the supporting frame, but may be composed in other form as required.

Since the pressure sensitive adhesive tape usually includes release paper, the tape application jig of the present invention preferably comprises a paper processing member for removing and clearing the release paper. The paper processing member may be of various shapes and sizes, and typically has metal or plastic rods, metal wires, etc. disposed at the release paper removal position. The paper release member is preferably attached to the tape holding member.

In implementing the present invention, there is no special limitation to the adherend and the pressure sensitive adhesive tape applied to it, and any of the adherend and adhesive tape generally used in this technical field may be used as they are or after suitable improvement or modification. For example, a wide variety of goods such as vehicles including automobiles, buildings and other structures, machinery, household electric appliances, etc. may be used as the adherend. The tape application jig of the present invention exhibits particularly beneficial operative effect when elongated goods having one or plural bent portions, curved portions and corners in its way are used as adherend. The bent portions may be of right angle or acute angle. Examples of adherend having such a particular shape include, for example, a door frame of an automobile, so-called sash door. The pressure sensitive adhesive tape consists of a layer of adhesive such as acryl adhesive, epoxy adhesive, urethane adhesive, silicone adhesive, phenol adhesive, vinyl chloride adhesive, etc. that is provided on an arbitrary base material such as paper, plastic material, etc., with release paper provided on top of them for protecting the adhesive layer. The pressure sensitive adhesive tape may be of any shape including roll-shaped type, sheet-shaped type, film-shaped type, etc. Size of the pressure sensitive adhesive tape is also varied over a wide rage from a tape of narrow width to a wide one. A pressure sensitive adhesive tape that is slitted beforehand in accordance with the shape of the adherend may be used as required.

Application of the pressure sensitive adhesive tape to the adherend using the tape application jig of the present invention may be implemented in accordance with various procedures, but typically is implemented preferably in accordance with the following steps.

The pressure sensitive adhesive tape is set into the tape application jig. Specifically, the pressure sensitive adhesive tape with release paper is inserted from a slit-shaped opening of the tape guiding space formed by two tape holding members arranged in the upper and lower positions, and is set. If the upper tape holding member is composed rotatably or openably, the tape holding member is displaced to an appropriate position to open the tape guiding space and the pressure sensitive adhesive tape with release paper is set.

With the pressure sensitive adhesive tape set in the tape application jig, the release paper is separated from the pressure sensitive adhesive tape. The separation of the release paper may be performed at a later stage, if desired.

By extension/contraction of the biasing member, the distance between the tape application head and the jig guide is increased, and the tape application jig is set to a predetermined surface portion of the adherend. During this process, the adhesive-coated surface of the pressure sensitive adhesive tape set in the tape application jig is adjusted so as to face the tape applying surface portion of the adherend. If the tape application head is composed such that it can be opened by a hinge mechanism, the tape application jig is set with the tape application head in an opened state, and then the tape application head is returned to the initial closed state and the tape application jig is securely fixed.

With the tape application jig fixed to the adherend, the tape application head is guided to the tape applying surface portion of the adherend. During this process, already exposed adhesive coated surface of the pressure sensitive adhesive tape is positioned so as to coincide with the starting end of the tape applying surface portion. Then, the adhesive tape is pressed and applied to the adherend under pressure.

The tape application jig is slid and advanced from the tape applying surface portion (starting end) of the adherend where the tape has been applied toward the terminating end of the tape applying surface portion. During this process, the applied tape is securely held, and deviation or damages of the tape can be prevented by the function of two tape holding member disposed in the upper and lower positions, respectively.

As the jig advances, the pressure sensitive adhesive tape is pressed onto the adherend so as to involve the tape applying surface portion, and the tape is applied to the adherend under pressure exerted by the pressing force of the jig.

Even when there are bent portions or curved portions in the way of the adherend, the tape application jig advances smoothly with the aid of the guide pin provided on the jig, and the adhesive tape can be applied stably without giving rise to problems in changing the advancing direction. Also in this case, the adhesive tape can be held reliably with the aid of the tape holding member.

When the jig leaves the terminating end of the tape applying surface portion of the adherend, the tape application operation of applying the pressure sensitive adhesive tape to the adherend is completed.

When above-described tape application operation is implemented using the tape application jig of the present invention, advancing direction of the tape application jig can be easily changed at bent portions etc. of the adherend. The pressure sensitive adhesive tape can be held reliably both at straight portion and bent portion, and since handling of tape becomes easier, tape application operation can be carried out smoothly. It should be appreciated that, when the tape application jig of the present invention is used, neither puckering nor inclusion of air bubbles occurs, and therefore, the need for additional work such as pressing the applied adhesive tape further with a squeegee is eliminated. The application of the pressure sensitive adhesive tape can be started not only from an end of the adherend but also from any desired surface portion of the adherend. By mounting the tape application jig to the surface portion, the tape application can be readily started from the desired portion.

EXAMPLES

Now, preferred examples of the tape application jig for a pressure sensitive adhesive tape according to the present invention will be described below with reference to appended drawings. It is to be understood that the tape application jig of the present invention is by no means restricted to the examples as described below.

Figure 3:
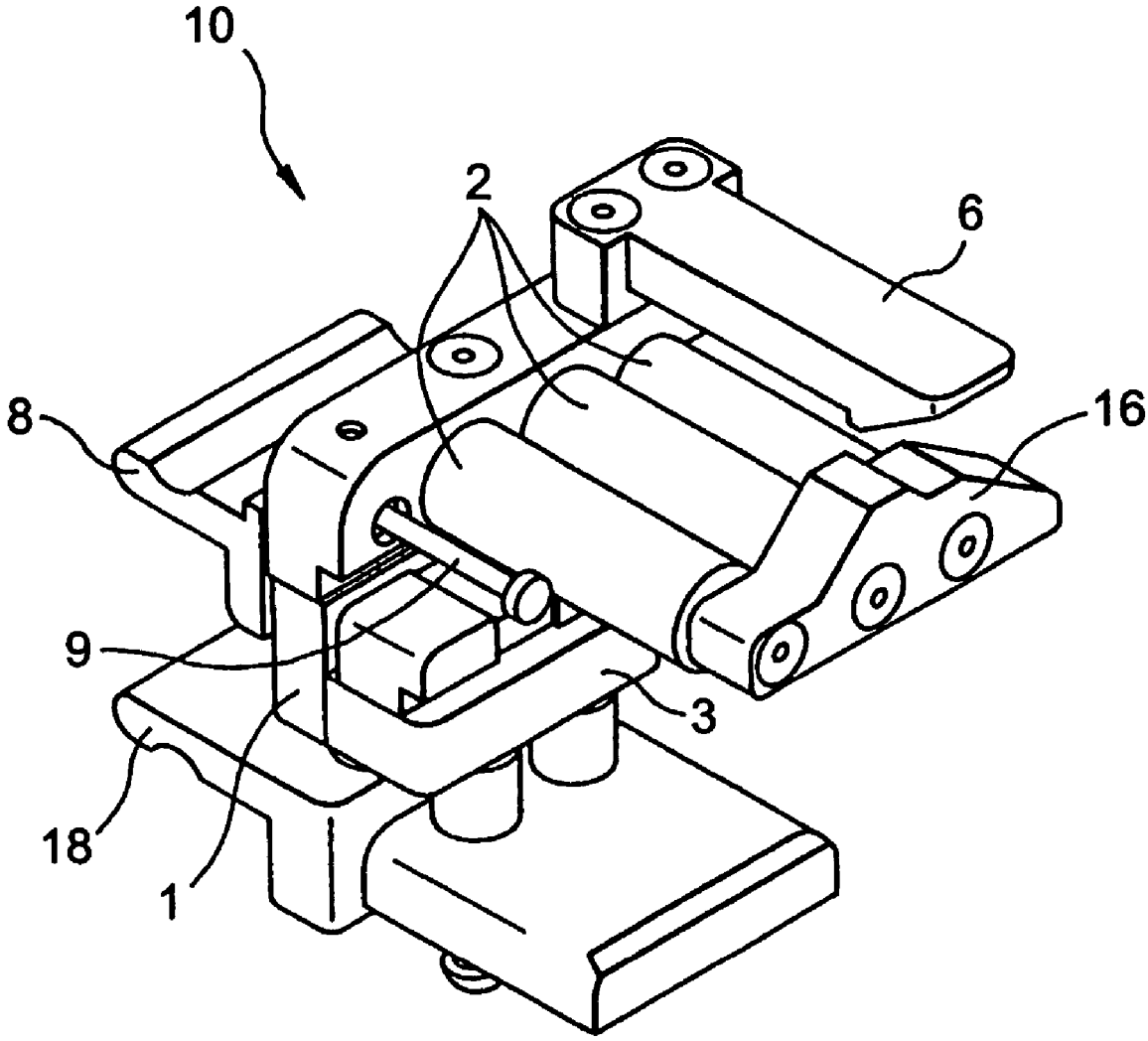
FIG. 3 is a perspective view showing a tape application jig for pressure sensitive adhesive tape according to a preferred embodiment of the present invention.

FIG. 3 is a perspective view showing a tape application jig according to one preferred example of the present invention. The tape application jig 10 is constructed compactly so as to permit hand-held operation, and comprises plate-shaped handles 8 and 18 as grasping tools. Each component of the tape application jig 10 is formed of polyacetal resin in order to increase strength and reduce weight. Core of the tape application jig 10 is a jig main body 1, to which various components (for example, a tape application head 2, a jig guide 3, and tape holding members 6 and 16) and their supporting frames are mounted. A guide pin is attached to the jig guide 3, although it is not shown in FIG. 3. The jig guide 3 is formed of a plastic material (in this case, polyacetal resin) which has slidability in itself.

Figure 4:
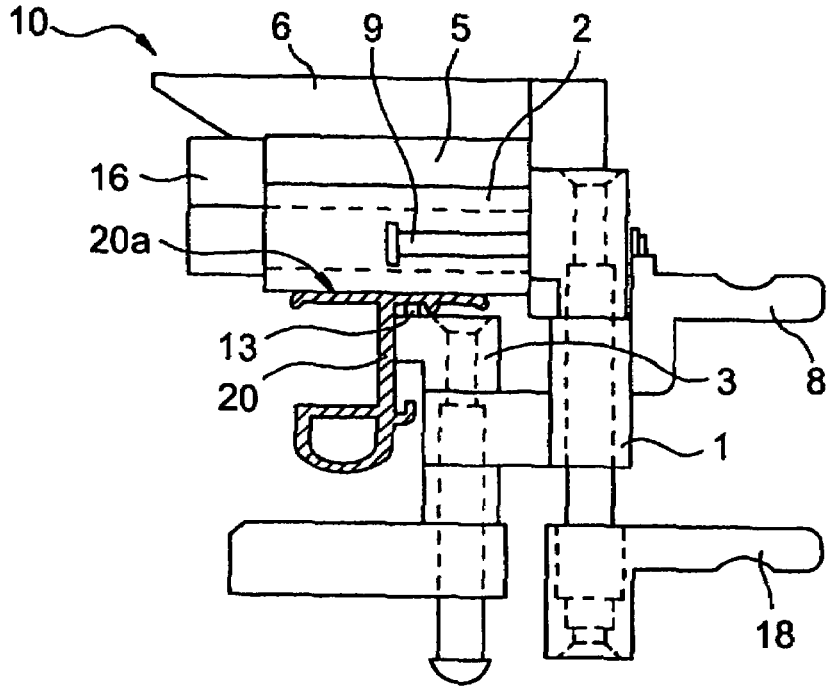
FIG. 4 is a front view showing a tape application jig for pressure sensitive adhesive tape according to another preferred embodiment of the present invention.

The tape application head 2 is positioned, as shown in FIG. 4, above the adherend 20 at the time of tape application, and is constructed so as to be pressed against the tape applying surface portion 20*a*. In the illustrated case, three tape application heads 2 of the same size are mounted to the jig. As shown in the figure, the tape application heads are mounted so as to extend from the sides of the supporting frames on the jig main body 1. Each of the tape application heads 2 is cylindrical in shape, and is covered on its surface with an elastic rubber for smooth implementation of tape application operation. In place of such tape application heads, a single large-size tape application head having, for example, an elliptical shape or other similar shape, may be used.

The tape application heads 2 further comprise two tape holding members 6 and 16 disposed in the upper and lower positions so as to face each other in vertical direction. One of the tape holding members 6 is mounted via a supporting frame above the tape application head 2. The other tape holding member 16 is mounted to the end surface of the tape application head 2. The tape holding member 6 is a bar-shaped member arranged stridingly over the tape application heads 2, and the tape holding member 16 is an angle member of special shape with gradually changing cross section. These tape holding members 6 and 16 are combined with the tape application head 2 positioned underneath so as to form a tape guiding space 5 (see FIG. 4). The tape holding member 6 as shown in the figure is of a fixed type. It may be modified to a rotatable type in order to permit easy mounting of the pressure sensitive adhesive tape in the tape guiding space.

With the aid of the jig guide 3 mounted to the jig main body 1, the tape application head 2 can be slid on the tape applying surface portion 20*a* of the adherend 20. When the tape application head 2 leaves the jig guide, the tape application jig can be easily set to the adherend 20, and when tape application operation for the pressure sensitive adhesive tape is to be started, the tape application head 2 is returned to initial position so as to face the jig guide.

In the case of the tape application jig 10 as shown in the Figure, a rod-shaped stainless steel paper processing member 9 is mounted adjacent to the tape application head 2. The paper processing member 9, which may be omitted if desired, is effective in removing and clearing the release paper, which is no longer required, from the pressure sensitive adhesive tape during the tape application operation. In place of the rod-shaped member shown in the figure, a metal wire member may be advantageously used in view of its light weight.

A spring (not shown) having the function of a biasing member is mounted to the jig main body 1. The spring can be extended/contracted using the handles 8 and 18 attached to the jig main body 1, and the separation between the jig guide 3 and the tape application head 2 can be thereby arbitrarily adjusted. Thus, by contracting the spring and thereby increasing the separation between the jig guide 3 and the tape application head 2, the process of mounting the jig main body 1 to the adherend 20 can be made easier. On the contrary, when the spring is returned to open state by stopping pressing the handles 8 and 18, the separation between the jig guide 3 and the tape application head 2 is decreased so that, when the pressure sensitive adhesive tape is applied, the force pressing the adhesive tape via the tape application head 2 against the adherend 20 (application pressing force) can be properly controlled.

Figure 5:
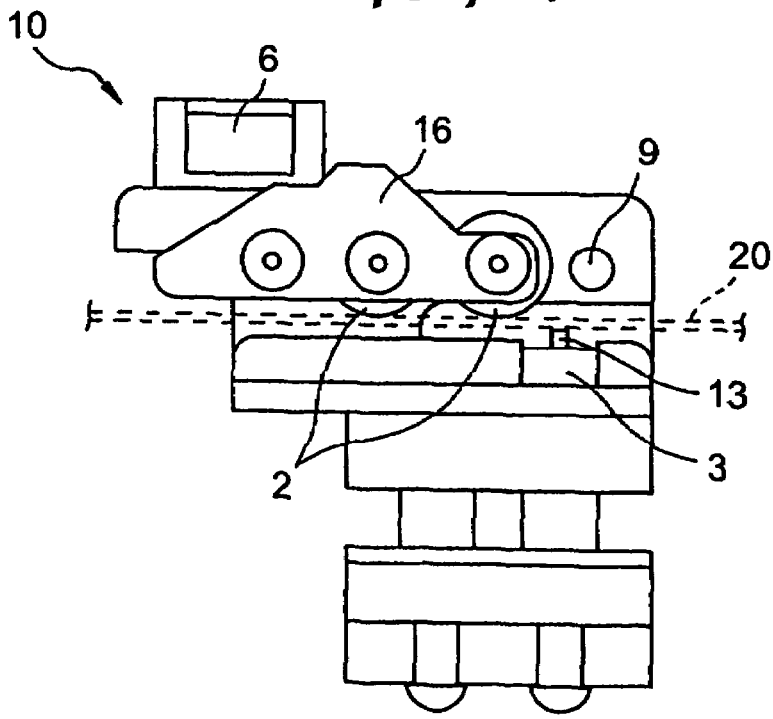
FIG. 5 is a side view of the tape application jig of FIG. 4.

FIGS. 4 and 5 are a front view and a side view, respectively, showing a tape application jig according to another preferred embodiment of the present invention, similar to the tape application jig shown in FIG. 3. Position of the adherend 20 relative to the tape application jig 10 could be understood easily.

The tape application jig 10 shown in the figure has a jig main body 1 formed of polyacetal resin. A jig guide 3 and a tape application head 2 are mounted to the jig main body 1 via respective supporting frames formed of polyacetal resin. The jig guide 3 is formed of a polyacetal resin block with a stainless steel guide pin 13 embedded in the upper surface. The tape application head 2 exists in such a position that the jig guide 3 is capable of abutting against the tape applying surface portion of the adherend 20 along the side of which the jig guide is moved, and is mounted to the jig main body 1 via a polyacetal supporting frame.

The tape application head 2 consists of three cylindrical guide rollers as in the head shown in FIG. 3, and comprises a pair of tape holding member 6 and 16 for forming a tape guiding space 5 enclosed by surroundings. The tape holding members 6 and 16 also have the same construction as shown in FIG. 3.

In the tape application jig 10 shown in the figure, the jig main body 1 further comprises unshown biasing member (spring), a paper processing member 9, and grasping tools (handles) 8 and 18 formed of polyacetal resin attached to it.

In the tape application jig 10 as described above, the jig guide 3 is composed of a block formed of polyacetal resin. It may be modified to other member, for example, the block may be replaced by one or more guide rollers. As an example, the jig guide 3 may be composed of two rotatable plastic guide rollers which are disposed side by side. Each of the guide rollers abuts against the adherend 20, and is capable of guiding the tape application jig 10 along the adherend. In accordance with the present invention, a guide pin is attached to the supporting frame to which these guide rollers are mounted.

FIGS. 6A-6D show the steps of tape application operation sequentially for applying a pressure sensitive adhesive tape to an adherend 20 using a tape application jig 10 according to another embodiment of the present invention. The adherend is a sash door of an automobile and has a large bent portion 21 in its way. A pressure sensitive adhesive tape, generally designated as blackout, is applied to the tape applying surface 20*a* of the adherend 20. The adhesive tape, not shown for simplicity of explanation, includes release paper for protecting the adhesive layer. The illustrated tape application jig 10 has basically the same construction as the tape application jig 10 as described above except that the jig guide 3 is replaced by a guide roller. Therefore, same reference numerals are used in the following explanation.

First, the pressure sensitive adhesive tape is inserted into the tape guiding space 5 formed underneath the tape holding member 6 of the tape application jig 10, by placing the front end of the adhesive tape to the inclined surface of the knotch at the front end of the tape holding member 6.

After inserting the pressure sensitive adhesive tape into the tape guiding space 5, the tape application jig is set to the adherend 20. First, tape application head 2 is slid and displaced to a position far away from the jig guide 3. Then, the spring is contracted to increase the separation between the jig guide 3 and the tape application head 2, and the tape application jig 10 is set to the adherend 20 and is fixed.

Figure 6A:
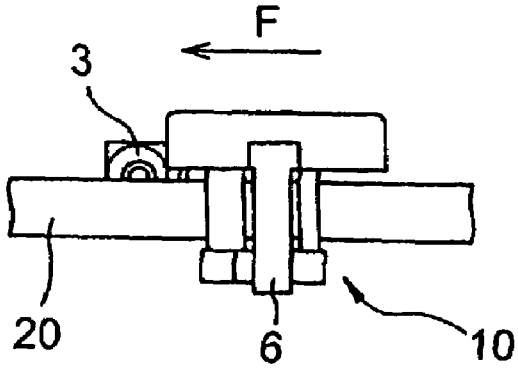
FIGS. 6A, 6B, 6C and 6D are views illustrating sequentially the steps of the movement of the tape application jig of the present invention at a bent portion of the adherend.

Then, the tape application head 2 is returned to the initial position so as to be ready to apply the pressure sensitive adhesive tape. After separating the adhesive tape from the release paper, the tape application jig 10 is slid and advanced, as shown in FIG. 6A, from the tape applying surface portion of the adherend 20 (starting end) where the adhesive tape has been applied, in the direction of the arrow F, toward the terminating end of the tape applying surface portion. As the jig 10 advances on the tape applying surface of the adherend 20, the pressure sensitive adhesive tape is pressed by the pressing force of the jig against the adherend 20 and is thereby adhered to it.

Figure 6B:
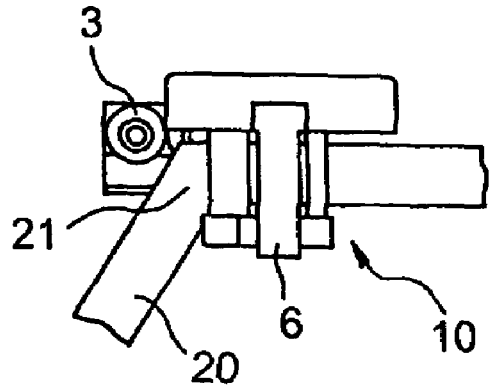
Figure 6C:
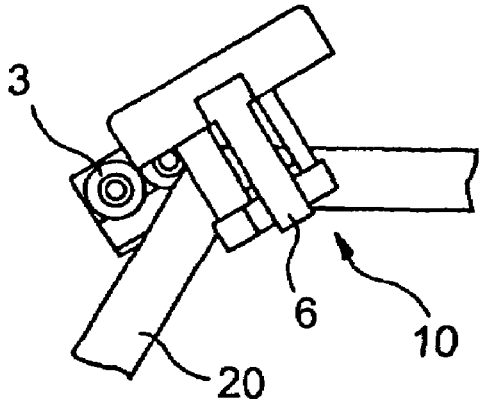
Figure 6D:
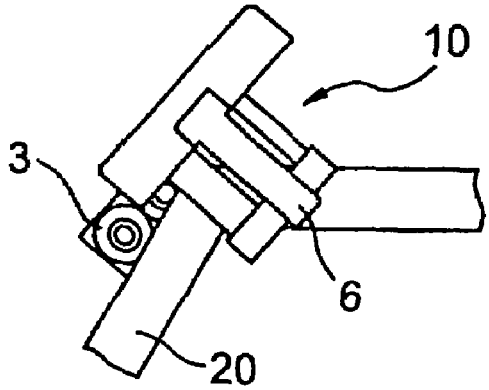

At the bent portion 21 of the adherend 20, as shown in FIGS. 6B to 6D, advancing direction of the tape application jig is smoothly changed. Orientation of the tape application jig 10 is changed with the jig guide 3 abutting against the side of the adherend 20, and in accordance with this change of orientation, advancing direction of the pressure sensitive adhesive tape guided in the tape guiding space 5 of the tape application jig 10 is changed while the tape is stably held by the tape holding member, and the adhesive tape is pressed against the tape applying surface portion of the adherend and is adhered to it.

As described above, by using the tape application jig of the present invention, even when the adherend is an elongated item and includes bent portions and curved portions in its way, advancing direction of the tape application jig can be changed easily, and the pressure sensitive adhesive tape can be reliably held in these portions and in straight portions.

The tape application jig needs not be removed at bent portions of the adherend, and complicated manual work is not required for tape application operation even at these portions. The tape application jig can be continuously moved along the adherend and application of the pressure sensitive adhesive tape can be carried out quickly, easily and stably without leaving a stop-mark on the adhesive tape.

Since a jig guide having a guide pin is disposed in opposition to the tape application head, the tape application jig can be moved smoothly during the tape application operation without departing from the intended path and the tape application operation can be carried out smoothly.

Further, by using the tape application jig of the present invention, the pressure sensitive adhesive tape can be applied easily and accurately without requiring high skill of workers and without requiring peeling-off of adhered tape even when the advancing direction (angle) of tape application changes in accordance with the change the shape of the adherend irrespective of the magnitude of the angle change.

The invention claimed is:

1. A tape application jig for applying a pressure sensitive adhesive tape to an adherend having a bent portion and/or curved portion, comprising:

a tape application head for applying said pressure sensitive adhesive tape under pressure to a tape applying surface of the adherend;

a jig guide which is to be disposed on a surface of the adherend opposite to said tape application head for guiding said tape application jig along the adherend;

a biasing member for biasing said jig guide and said tape application head toward one another to thereby control tape application and pressing force exerted on the pressure sensitive adhesive tape, when the tape applying surface of the adherend is in position there between for receiving the pressure sensitive tape; and tape holding member structure defining at least a portion of a tape guiding space and an entrance into said tape guiding space, said entrance allowing the tape to be inserted into said tape guiding space in a direction generally transverse to a direction of movement of the tape through said tape guiding space, said entrance being open during the application of the tape to a bent portion and/or curved portion of the adherend, wherein said tape holding member structure comprises first and second tape holding members fixed relative to said tape application head and spaced apart so as to define said entrance into said tape guiding space, said tape application head having an axis generally transverse to (1) the direction of movement of the tape and (2) an axis passing through said tape application head and said jig guide, wherein a portion of said second tape holding member extends away from said tape application head and toward said first tape holding member so as to define a portion of said tape guiding space, and a part of said second tape holding member extends beyond a part of said first tape holding member, located adjacent said entrance into said tape guiding space, in a direction generally transverse to the direction of movement of the tape through said tape guiding space and to the axis of said tape application head.

2. The tape application jig of claim 1, wherein said jig guide further comprises a guide pin capable of being received in a groove provided in the adherend surface opposite to the tape applying surface of the adherend, such that said guide pin engages the groove in the adherend surface, when said tape application jig is in position on the adherend to apply the pressure sensitive tape to the tape applying surface, so as to prevent the tape application jig from being removed from the adherend in a direction other than the direction the tape application jig travels when applying the pressure sensitive adhesive tape, without first biasing said tape application head and said jig guide apart.

3. The tape application jig according to claim 2, wherein said jig guide further comprises a block and said guide pin is embedded in said block.

4. The tape application jig according to claim 2, wherein said guide pin has a diameter of about 1 mm to about 5 mm.

5. The tape application jig according to claim 2, wherein said jig is capable of being slid continuously on the tape applying surface portion of the adherend irrespective of the shape of the adherend and without removing and re-attaching the tape application jig.

6. The tape application jig according to claim 2, wherein said jig guide comprises at least one roller.

7. The tape application jig according to claim 2 in combination with an adherend that is part of a vehicle and a pressure sensitive adhesive tape.

8. The tape application jig according to claim 2, in combination with a pressure sensitive adhesive-backed paint replacement film that can be applied to an adherend with said jig.

9. The combination according to claim 8, in combination with at least a part of a window frame of a vehicle.

10. The tape application jig according to claim 1, wherein said jig is capable of being slid continuously on the tape applying surface portion of the adherend irrespective of the shape of the adherend and without removing and re-attaching the tape application jig.

11. The tape application jig according to claim 1, wherein said first tape holding member comprises a plate member having a rectangular cross section and said second tape holding member comprises an opposing plate member having an angle cross section.

12. The tape application jig according to claim 1, wherein said tape application head comprises at least one cylindrical member.

13. The tape application jig according to claim 12, wherein said cylindrical member has a surface layer having the function of a slide promoting layer or a buffer layer for the pressure sensitive adhesive tape.

14. The tape application jig according to claim 1, wherein said jig guide comprises a plate member having a rectangular cross section.

15. The tape application jig according to claim 1, wherein said jig guide comprises at least one roller.

16. The tape application jig according to claim 1, wherein said tape holding member further comprises a paper processing member for removing and clearing release paper of the pressure sensitive adhesive tape.

17. The tape application jig according to claim 1 in combination with an adherend that is part of a vehicle.

18. The combination according to claim 17, in combination with a pressure sensitive adhesive tape.

19. The combination according to claim 17, wherein said adherend is part of a window frame of a vehicle.

20. The tape application jig according to claim 1, in combination with a pressure sensitive adhesive-backed paint replacement film that can be applied to an adherend with said jig.

21. The tape application jig according to claim 1, wherein said first tape holding member has a longitudinal axis generally parallel with the axis of said tape application head and said second tape holding member has a longitudinal axis generally transverse to the longitudinal axis of said first tape holding member.

22. The tape application jig according to claim 1, wherein said first tape holding member has a center axis generally parallel to the axis of said tape application head and said second tape holding member has a center axis generally parallel to the axis of said tape application head and said center axes of said first and second tape holding members are spaced apart from one another in the direction of movement of the tape through said tape guiding space.

23. The tape application jig according to claim 1, wherein at least a portion of a sloping surface of said first tape holding member is positioned adjacent to at least a portion of a sloping surface of said second tape holding member so as to define at least a portion of said entrance.

24. The tape application jig according to claim 1, wherein said second tape holding member has a sloping surface extending in the direction of movement of the tape through said tape guiding space.

25. The tape application jig according to claim 24, wherein said first tape holding member has a sloping surface extending generally transverse to the direction of movement of the tape through the tape guiding space.

26. The tape application jig according to claim 24, wherein said second tape holding member further comprises an intermediate surface spaced from said second member sloping surface, said intermediate surface being positioned in a plane that extends through said first tape holding member.

27. The tape application jig of claim 1, wherein said part of said first tape holding member and said part of said second tape holding member define a portion of said entrance into said tape guiding space.

28. A process for applying a pressure sensitive adhesive tape to an adherend having a bent portion and/or curved portion, comprising:

attaching the tape application jig according to claim 1 to the adherend; and applying the pressure sensitive adhesive tape to the adherend by the moving the jig along the adherend.

29. The process as set out in claim 28, wherein said applying the pressure sensitive adhesive tape to the adherend comprises allowing the pressure sensitive adhesive tape to exit the tape guiding space through the entrance when the pressure sensitive adhesive tape is being applied to a bent portion and/or curved portion of the adherend.

* * * * *